US006605025B1

(12) United States Patent
Kjersem

(10) Patent No.: US 6,605,025 B1
(45) Date of Patent: Aug. 12, 2003

(54) THERAPEUTIC SEAT DEVICE

(76) Inventor: Jens A. Kjersem, Einarvikgata 1, 6002 Alesund (NO)

( * ) Notice: Subject to any disclaimer, the term of this patent is extended or adjusted under 35 U.S.C. 154(b) by 0 days.

(21) Appl. No.: 09/428,041

(22) Filed: Oct. 27, 1999

(30) Foreign Application Priority Data

Oct. 30, 1998 (NO) ..... 985076

(51) Int. Cl.[7] ..... A63B 71/00

(52) U.S. Cl. ..... 482/148; 482/142; 297/158.1; 601/49

(58) Field of Search ..... 482/142, 148; 601/49; D6/382, 364, 349, 334, 596; 224/155; 114/363; 190/8; 182/33; 297/158.4, 175; 5/690, 12.1; 472/95, 106–114

(56) References Cited

U.S. PATENT DOCUMENTS 1,677,531 A * 7/1928 Shanton ..... 272/55
1,701,684 A * 2/1929 Lee
2,407,786 A * 9/1946 Keest
2,664,940 A * 1/1954 High
2,872,966 A * 2/1959 Chamness
4,303,219 A 12/1981 Carrick

FOREIGN PATENT DOCUMENTS

NO 302 853 2/1994
NO 302853 B1 * 2/1994

* cited by examiner

*Primary Examiner*—Jerome W. Donnelly
*Assistant Examiner*—Lori Baker Amerson
(74) *Attorney, Agent, or Firm*—Garrettson Ellis; Seyfarth Shaw

(57) ABSTRACT

A therapeutic seat device which in combination comprises:

(a) a support (1) having elements (2, 3, 6) for receiving a separate seat member; and (b) a seat member comprising a seat (4) fastened to an elongate element for elastic, resilient interaction with the support.

18 Claims, 3 Drawing Sheets

THERAPEUTIC SEAT DEVICE

The present invention relates to a therapeutic seat device or, more specifically, a resilient, therapeutic seat device, intended primarily for use when training above all the muscles around and along the spinal column, but also other musculature of the body.

NO 302.853-B1 describes a seat device which allows adjustment of the postural balance of the upper part of the body so as to obtain a sitting posture that is as stress-free and anatomically correct as possible.

The present invention is an independent development of the ideas on which the aforementioned '853 was in fact based.

The object of the invention is to provide an improved rocking seat device which in addition to a pure sitting function can also be used as an effective training apparatus for use, for example, in group training to music.

It is an object of the invention to provide a seat device having a function that enables a person in a sitting position to carry out exercise movements to musical rhythms, and at the same allows the user, whilst exercising and also in time with the music played, if any, to adjust the inherent resistance of the seat so as to be able to move his body in exact time with the musical rhythms played.

A not insignificant amount of today's physical training takes place in groups and to music. Aerobics may be mentioned as one example, and other examples include apparatus training such as spinning.

If a seat device of this kind is to be useful for physical training which is based on rocking on an elastic seat in time with music, the seat device must have adjustment means which allow a rapid and reliable adjustment of the seat in an individual manner for each individual user, and it must also be possible to do this, at least to a certain extent, during use.

It is thus essential in a construction of this kind that the inherent resistance of the seat to tilting movements should not only be capable of being adjusted beforehand, but that it should also be equipped with an adjustment mechanism that can be operated whilst rocking takes place in time with the music.

In general, exercising whilst in a sitting position is a very safe method of exercising which allows the user himself to control the load that feels right for his back.

The method is a safe method of exercising for many people suffering from different types of disorders, but is especially favourable in cases of back injuries because it gives a less one-sided load during training. The body or spinal column is not subjected to shaking, jolts or blows, sudden twists, jumps or other forms of stress.

Furthermore, sitting, rocking exercise can be done by people of virtually any age, even by those aged 80 to 90.

Furthermore, physical training of this kind may be favourable for many accident victims, for example, after serious injuries such as foot amputations as a result of motorcycle accidents, and also patients suffering from heart disease, CP patients or the like, especially also if the seat device has grips or body rests of various types.

Gentle rocking exercise in a sitting position provides the body/spinal column with slow, gentle and generally symmetrical exercise movements. The user of a suitable seat device can determine the muscle loading by leaning more or less backwards in the seat in his seated exercise position.

It general, it can be said that persons capable of walking or driving a car to a training centre will also be capable of carrying out a strengthening exercise of this kind.

As mentioned above, this kind of rocking exercise in a sitting position is especially good for the muscles around and along the spinal column, the adductor muscles and the abdominal muscles, but basically the entire body musculature is used, especially if the arms are used in exercises with elastic bands or other elastic bend and stretch resistant mechanisms.

In this way, a good strength training of the musculature which helps to maintain the postural aspect of a good sitting posture is obtained. It is therefore not without importance that the training takes place in an upright, sitting position of use where the postural musculature and movement and circulation functions of the spinal column in a sitting position during training are taken into account.

In sitting, rocking exercise of this kind, the lumbar joints of the spinal column are made to move vertically, locking between the individual vertebrae can be mobilised and it will be possible to build up the strength of the small deep-lying supporting muscles. On the whole, the training will thus increase the stability of the individual vertebrae so that the spinal column as a whole is strengthened.

The training of the smallest and most deep-lying supporting muscles that are responsible for the stability between the individual vertebrae will help to strengthen the position of the vertebrae in relation to gravity and uneven loads, and will thus be capable of improving minor misalignments of individual vertebrae in that they are finely adjusted owing to an enhanced and more symmetrical function of the small muscles.

A strengthening of the small supporting muscles helps to relieve the larger muscle groups, which in turn helps to counteract local misalignments, dislocations or locking and this results in an improved functional spinal column, where the major muscles can relax more and merely take part in the balance of the spinal column and the body in general, and possibly help in the event of substantial muscular strains.

A training of the small deepest lying supporting muscles will also help to avoid weak individual joints which suddenly give way on unexpected loads, a so-called "crick" in the back.

In addition to the aforementioned advantages, the slow, pumping movement due to rocking will also help to give a correct stimulation of tissue after a newly operated prolapsed disc in that the gentle, symmetrical, rocking, vertical exercise movements stimulate diffusion and thus absorption of nutrients in the discs and the tissue between the vertebrae.

The object of the present invention is to provide a therapeutic seat device which allows training in accordance with that outlined above, and this seat device is characterised in that it comprises:

a) a support with elements for receiving a separate seat member; and b) a seat member comprising a seat fastened to an elongate element for elastic, resilient interaction with the support.

In one embodiment the elongate element of the seat member is elastic, and the element for receiving the elongate element of the seat member consists of two crossbars extending parallel to one another, substantially at the same height and basically at right angles to the elongate element.

In one embodiment these receiving elements may be in the form of an optionally vertically displaceable sleeve.

It is an advantage that the seat be displaceable along the elongate element of the seat member and/or that at least one of the receiving bars can be displaced vertically and/or horizontally.

The support preferably has a downwardly open U or V-shaped part wherein the aforementioned bars are fastened close to the bottom of the U or the apex of the V.

It may be an advantage that the elongate element of the seat member and/or the support be equipped with means for fixing or locking these parts relative to one another.

These means may be in the form of an elongate locking groove in the elongate element of the seat member and corresponding means on the support.

To facilitate fixing in a desired position, the elongate element of the seat member may be provided with transverse open curved recesses, preferably on the underside, for interaction with one of the transverse bars.

To allow use by persons of varying sizes, the seat device according to the invention may be equipped with several sets of receiving elements, arranged one above the other, for the elongate element of the seat member.

In one particular embodiment of the invention, the elasticity is provided, at least in the main, by a resilient element between the distal end of the support and the distal end of the elongate element of the seat member. A resilient element of this kind may be made of various materials, including steel, rubber or the like.

The invention will now be illustrated in more detail with reference to the accompanying drawings wherein:

FIGS. 1 and 2 show the main principle of the invention.

Firstly, as indicated above, the inventive therapeutic seat device comprises a support 1.

Figure 1:
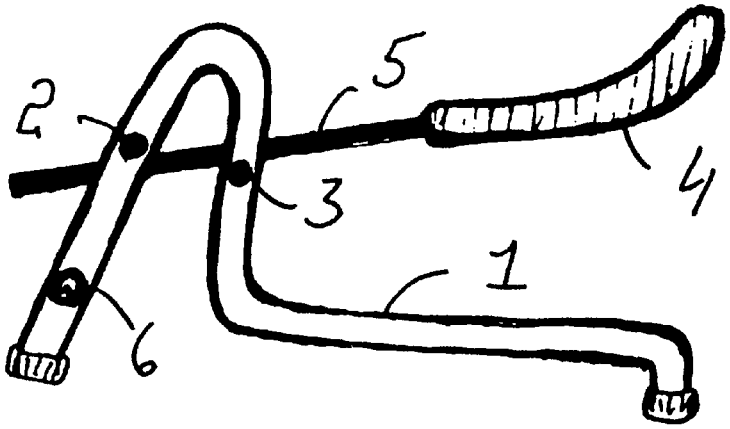
FIG. 1 is a side view of one embodiment of the seat of the invention.
Figure 2:
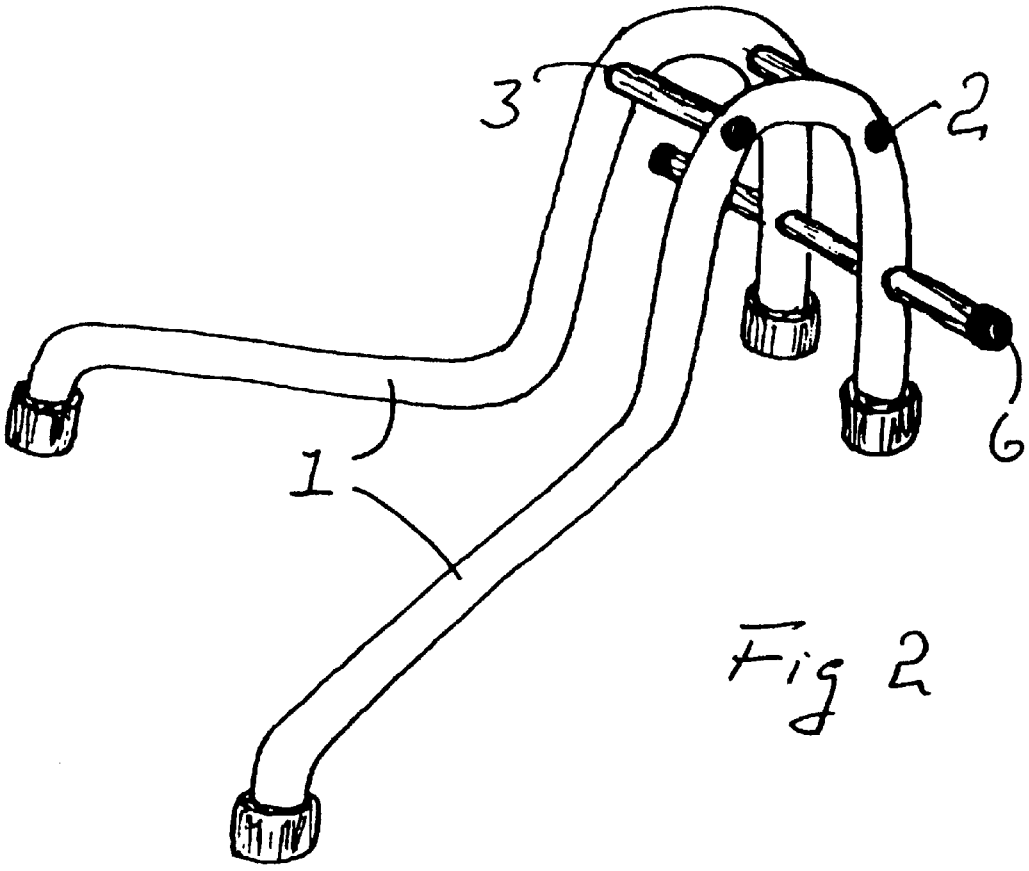
FIG. 2 shows the support according to FIG. 1 seen at an angle from above.

This support 1 in the embodiment shown in FIGS. 1 and 2 is made of two suitably bent lengths of tubing which at the proximal end, i.e., in the area from the seat 4, comprises two legs which at the median and distal end are given a pronounced U-shape, the opening of the U facing downwards.

The elements of the support 1 are held together by two crossbars 2 and 3, arranged basically parallel with one another, close to the bottom of the U and essentially at the same height, and in the illustrated embodiment the elements of the support 1 are also held together by means of a foot rest 6.

The seat member comprising an elongate element 5 and a seat 4 is shown in FIG. 1.

The elongate element 5 is inserted between the crossbars 2 and 3, over the last-mentioned and under the first-mentioned.

In the embodiment shown in FIG. 1 it is the elongate element 5 which gives the elastic, resilient interaction with the support, the element being made of a rigid but resilient, elastic material.

Figure 3:
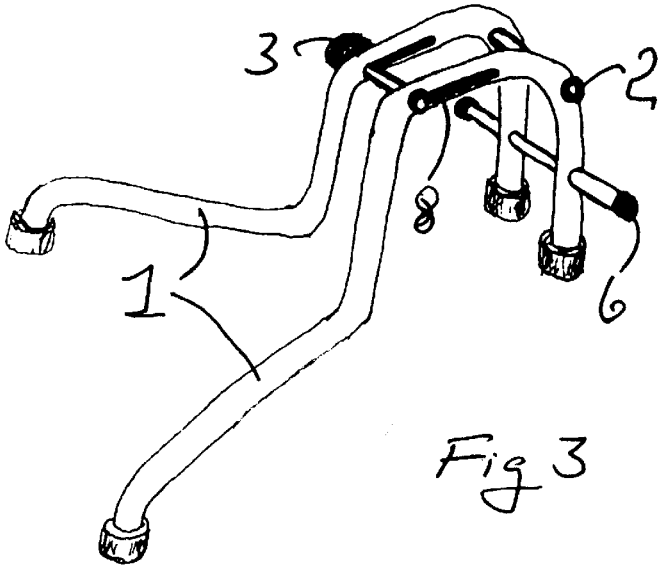
FIG. 3 shows another embodiment of the support.

FIG. 3 shows an embodiment where the U-shape of the support 1 has been given a somewhat more open form, which allows an adjustment of the distance between the crossbars 2 and 3, in that the bar 3 can be displaced in the "longitudinal direction" of the apparatus in the groove indicated by reference numeral 8.

The crossbar 3 should be capable of being locked in any desirable position.

This means of adjustment makes it possible for the user quickly and without any interruption of his training to adjust his rocking frequency during the exercises described above.

Furthermore, it may be an advantage to be able to adjust the position of the seat 4 on the element 5, and in a (non-illustrated) embodiment, the seat 4 is equipped with an optional through opening for the element 5 and associated fastening means.

Figure 4:
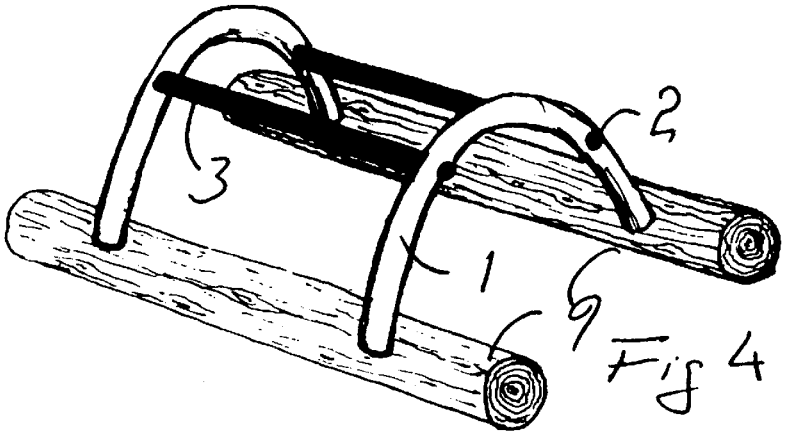
FIG. 4 shows an alternative embodiment of the principle shown in FIGS. 1 and 2.
Figure 5:
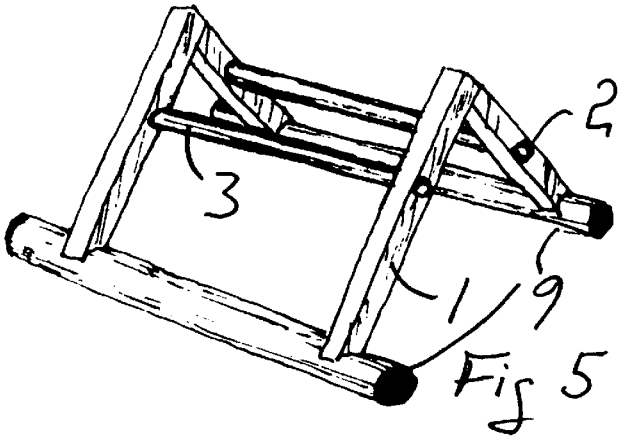
FIG. 5 shows another alternative embodiment of the principle shown in FIGS. 1 and 2.

In the embodiments shown in FIGS. 4 and 5, the support has been given a somewhat simplified form and comprises in principle two long feet 9, connected via a U-shaped and V-shaped bracket respectively to transverse bars 2, 3 as described above.

Figure 6:
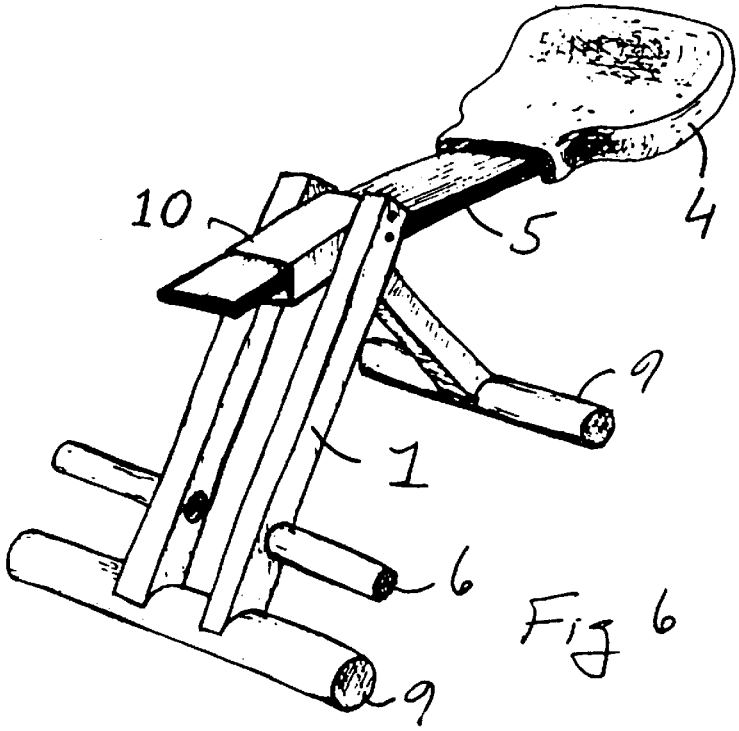
FIG. 6 shows a second fundamental embodiment of the invention.

FIG. 6 shows an embodiment where in the support comprises two feet 9, in principle connected via an V-shaped bracket, but wherein the two crossbars are replaced by a sleeve 10.

In the embodiment shown in FIG. 6, it is the elongate element 5 of the seat member that is elastic, but here it is conceivable that the sleeve 10 per se may be equipped with a device that is resilient relative to the support 1 so that the elongate element 5 may be slightly rigid or optionally completely rigid.

Figure 7:
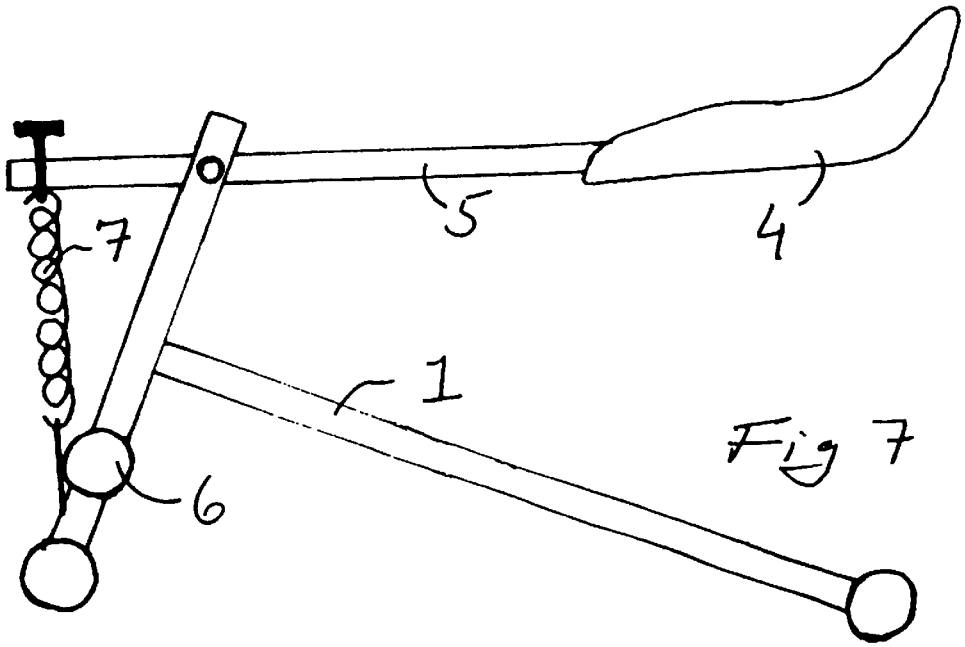
FIG. 7 shows a third fundamental embodiment of the invention.

FIG. 7 shows an embodiment wherein the springing which allows the rocking movement of the seat 4 via the elongate element 5 is provided by means of a spring as indicated by the reference numeral 7.

This may be a spiral spring or any other elastically resilient, load-safe device, e.g., a strong rubber band.

As indicated above, it may be an advantage that the elongate element of the seat member and/or the support be equipped with means for fixing or locking relative to one another.

Such means may be in the form of non-illustrated longitudinal locking grooves in the elongate element of the seat member with corresponding locking means on the support.

Such means are known per se, but the object is to be able to lock the two parts to each other to prevent intended or unintended separation of the parts.

In the embodiment that in particular is illustrated in FIG. 1, it is also conceivable that the elongate element 5 may be equipped with parallel, transverse, curved recesses (not shown in the figure) having a radius corresponding to the radius of the crossbar 3, so as to help the seat member 4, 5 remain in place during rocking.

To make the use of the seat device soft and resilient, it is possible within the context of the invention to equip the receiving elements 2, 3 with a non-illustrated coating of rubber or another elastic material, or blocks of a similar material can be placed between the elements 2, 3 and the elongate element 5.

To facilitate the use by persons of varying body sizes, it is also conceivable that several receiving elements 2, 3 or 6 may be arranged one above the other in two or possibly more sets.

The seat device according to the invention can be made of any suitable material wherein the main considerations for the choice reside in strength, stability and possibly elasticity, which is especially relevant in the case of the elongate element 5 in those instances when this is to provide the necessary elasticity.

Glass, aramide or carbon fibre reinforced materials are the preferred choice when the elasticity for the rocking movement is to be provided by the element 5.

That which is claimed:

1. A therapeutic seat device, comprising a support having elements for receiving a separate seat member, characterized in that the seat member comprises a seat on a generally straight, elongated element for elastic or resilient rocking by a user sitting in the seat member, said elements being for receiving an elongated element of the seat member and being in the form of a sleeve having an adjustable angle of inclination.

2. A seat device according to claim 1, characterized in that the elements for receiving the elastic element of the seat member comprise two cross bars extending parallel to one another, at essentially the same height and at right angles to the elongated element.

3. A seat device according to claim 2 characterized in that the support has a downwardly open U or V-shaped part wherein the bars are attached close to the bottom of the U or the apex of the V.

4. A seat device according to claim 2 characterized in that at least one of the bars can be displaced vertically and/or horizontally.

5. A seat device according to claim 1, characterized in that the seat is displaceable along the element.

6. A seat device according to claim 1 characterized in that the elongated element from the support is equipped with means to prevent displacement or removal of the element from the support.

7. A seat device according to claim 6 characterized in that the means are in the form of a longitudinal locking groove in the bar with corresponding means on the support.

8. A seat device according to claim 1 characterized in that the element on the underside thereof is equipped with a number of transverse, curved recesses for interaction with the proximal crossbar.

9. A seat device according to claim 1, characterized in that at least two sets of receiving elements are provided one above the other.

10. The seat device of claim 1 in which said elongated element can engage said support at a range of positions along said elongated element, whereby the position of said seat and elongated element may be adjusted by a user.

11. The seat device of claim 1 in which said elongated elastic element comprises a rigid but resilient elastic material.

12. The seat device of claim 1 in which said elongated element is angled upwardly from the horizontal in its unstressed configuration.

13. The seat device of claim 12 in which the position of said seat relative to said support can be adjusted.

14. The seat device of claim 1 in which the position of said seat relative to said support can be adjusted.

15. A therapeutic seat device comprising a support having elements for receiving a separate seat member, said seat member comprising an elongated flexible element for elastic or resilient rocking by a user in the seat member, said support being capable of engaging said elongated element at different positions along the length of said elongated element to permit adjustment of said seat by a user, said elements being for receiving said elongated element of the seat member and being in the form of a sleeve.

16. The seat device of claim 15 in which the elements for receiving the elongated element of the seat member comprise two cross bars extending parallel to one another at substantially right angles to said elongated element.

17. The seat device of claim 15 in which said support has a downwardly open U or V-shaped part.

18. The seat device of claim 15 in which at least one of the cross bars can be displaced vertically and/or horizontally.

* * * * *